US009827485B2

(12) United States Patent
Brinkman

(10) Patent No.: US 9,827,485 B2
(45) Date of Patent: Nov. 28, 2017

(54) SYSTEM AND METHOD FOR PROVIDING AND CONDUCTING WAGERING DICE BASED GAME

(71) Applicant: Michael William Brinkman, Ann Arbor, MI (US)

(72) Inventor: Michael William Brinkman, Ann Arbor, MI (US)

(73) Assignee: MICHIGAN MUSE, LLC, Ann Arbor, MI (US)

( * ) Notice: Subject to any disclaimer, the term of this patent is extended or adjusted under 35 U.S.C. 154(b) by 92 days.

(21) Appl. No.: 14/693,543

(22) Filed: Apr. 22, 2015

(65) Prior Publication Data

US 2015/0297979 A1 Oct. 22, 2015

Related U.S. Application Data

(60) Provisional application No. 61/982,561, filed on Apr. 22, 2014.

(51) Int. Cl.

| | |
|---|---|
| ***A63F 9/04*** | (2006.01) |
| ***G07F 17/32*** | (2006.01) |
| *A63F 3/00* | (2006.01) |

(52) U.S. Cl.

CPC ..... *A63F 9/04* (2013.01); *A63F 3/00157* (2013.01); *G07F 17/32* (2013.01); *A63F 9/0413* (2013.01); *A63F 2003/00164* (2013.01); *A63F 2009/0471* (2013.01); *A63F 2009/0477* (2013.01)

(58) Field of Classification Search

CPC ..... A63F 3/00157; A63F 2003/00164; A63F 9/04; A63F 9/0413; A63F 2009/0471; A63F 2009/0477

USPC ..... 273/146, 274, 138.1

See application file for complete search history.

(56) References Cited

U.S. PATENT DOCUMENTS

| | | | | |
|---|---|---|---|---|
| 6,273,423 | B1 * | 8/2001 | Promutico | A63F 3/00157 273/146 |
| 6,435,505 | B1 * | 8/2002 | Hoffman | A63F 3/00157 273/146 |
| 6,464,225 | B1 * | 10/2002 | Webb | A63F 3/00157 273/139 |
| 6,896,264 | B1 * | 5/2005 | Haber | A63F 3/00157 273/138.1 |
| 2003/0032471 | A1 * | 2/2003 | Darder | A63F 3/00157 463/16 |
| 2006/0033267 | A1 * | 2/2006 | Wong | A63F 3/00157 273/142 R |

(Continued)

OTHER PUBLICATIONS

Brinkman, Double or Nothing, Board Instructions, 1984, pp. 1-6, Sand Castle Game Company, Alpena, MI 49707 USA.

*Primary Examiner* — Benjamin Layno

(74) *Attorney, Agent, or Firm* — Howard & Howard Attorneys PLLC

(57) ABSTRACT

A system, game table, and method for allowing wagers to be made on a game, and particularly dice games using multiple sets of dice, and awarding a payout as a function of an outcome of the game is provided. The dice game may be played on a physical table using physical apparatuses or may be implemented using one or more computer based gaming machines. The dice game may be played over a network, on line and/or using one or more mobile devices. The dice game may be played using a stand-alone gaming machine. The dice game may be played with one or more players.

30 Claims, 5 Drawing Sheets

(56) References Cited

U.S. PATENT DOCUMENTS

| | | | | |
|---|---|---|---|---|
| 2006/0119037 | A1* | 6/2006 | Watkins | A63F 3/00157 273/146 |
| 2014/0001704 | A1* | 1/2014 | Manttan | A63F 3/00157 273/146 |

* cited by examiner

SYSTEM AND METHOD FOR PROVIDING AND CONDUCTING WAGERING DICE BASED GAME

CROSS-REFERENCE TO RELATED APPLICATIONS

The present application claims priority to U.S. Provisional Patent Application Ser. No. 61/982,561, filed Apr. 22, 2014, the entire disclosure of which are hereby incorporated by reference.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

BACKGROUND OF THE INVENTION

1. Field of the Invention

The present invention relates generally to systems and methods of providing and conducting wagering games, and more particularly, a system and method of providing and conducting wagering on a dice game with multiple sets of dice.

2. Description of the Related Art

There are a wide variety of games that are played for entertainment, for education, or for enhancing memory or brain function. Such games include video games, board games, card games, and dice games. There are many variations of dice-based casino games that have been played for several centuries. Sic-bo, tai sai, dai sui, big and small, hi-lo, grand hazard, and chuck-a-luck are all variations of dice-based games available in casinos today. Sic-bo is an ancient Chinese variation of a wager based dice game involving three dice and a plurality of betting options. Both Grand Hazard and Chuck-a-Luck are English dice games involving two dice. All casino dice games are traditionally played in the same manner involving a felt play-table with a plurality of available bets in some sort of customized design.

In operation of a typical dice game, players place chips or tokens on a betting layout located on a play table with a plurality of wager combinations, and then a croupier or dealer throws the necessary amount of dice in order to determine a winning combination. The dice are usually thrown across the play table, although cages or transparent containers holding the dice may also be used. The dice come to rest and the winning combination of numbers on the dice is displayed. Afterward, the croupier or dealer settles the various wagers placed on the play table layout in accordance with predetermined rules and wager odds and the process is repeated.

Ever since the introduction of computers, the internet, and more recently, smart phones and computer tablets, many traditional board and dice games have been converted, updated, and/or redesigned to accommodate these new platforms. Thanks to advances in the telecommunications network and the internet, users may now play these types of games on their computers, smart phones and tablet devices, and may participate in games with players from remote locations.

It is known to provide a dice game that uses four dice and a game board for four players. Each player faces on side of the board. In this board dice game, to win more money than any other player, players win money by advancing up "dollar lines" on the board in front of each player, advancing around a "Matchtrack" around the board, and placing side bets.

One disadvantage of this board dice game is that it is limited to four players. Another disadvantage of the board dice game is that it does not allow for a live dealer. Yet another disadvantage of the board dice game is that a roll of four dice disproportionally weighs the odds of winning bets in favor of the bettors rather than having wager odds in favor of the house, as is necessary in casinos. Still another disadvantage is that it takes too much time to advance around the Matchtrack and cannot be used in a live casino.

It is desirable to provide a new dice game with multiple sets of dice that can be played on a table in a live casino or electronically on-line. It is also desirable to provide a dice game with multiple sets of dice that allows for a limitless number of players. It is further desirable to provide a dice game with multiple sets of dice that allows for a dealer. It is still further desirable to provide a dice game with multiple sets of dice that allows for faster play. Therefore, there is a need in the art to provide a new dice game with multiple sets of dice that meets these desires.

SUMMARY OF THE INVENTION

In a first aspect of the present invention, the present invention provides wagering games, and particularly dice games using multiple sets of dice. The dice game may be played on a physical table using physical apparatuses or may be implemented using one or more computer based devices or gaming machines. The dice game may be played over a network, on line and/or using one or more mobile devices. The dice game may be played using a stand-alone gaming machine. The dice game may be played with multiple players; however, some of the players may be computer-based players.

In a second aspect of the present invention, the present invention provides a dice game for at least one player including a first set of dice, the first set of dice including a first die of a first color and a second die of a second color, a second set of dice including a third die, a fourth die and a fifth die each of the same color, and a player personal gaming area for the at least one player to place a wager on a first roll of the first dice and a wager or series of wagers on at least one roll of the second set of dice relating to the associated dice game. Wherein, utilizing the first set of dice, a first dice roll has an outcome that depends on the two numbers that turn up on the first die and the second die, the first die determining a match number and the second die determining at least one dice roll of the second set of dice, utilizing the second set of dice, the at least one roll of the second set of dice having an outcome that depends on the three numbers that turn up, and paying a payout to the at least one player according to each wager and the outcome of the dice rolls.

In a third aspect of the present invention, the present invention provides a system for providing an electronic dice game to a plurality of players including a display device for displaying the game, a computer coupled to the display device, the computer having memory for storing the game, and at least one controller coupled to the computer and the display device, the at least one controller being configured for allowing at least one player to be inputted into the computer, wherein the computer is configured to utilize a first set of dice and a second set of dice, the first set of dice including a first die of a first color and a second die of a second color to establish by the roller of the first set of dice a match number for each roll of the second set of dice in that turn, the second set of dice including a third die, a fourth die and a fifth die each of the same color, the match number being associated with the roller of the first set of dice, to establish in connection with the match number an anti-match number for each roll of the second set of dice in a turn, this anti-match number being predetermined according to the established match number, to receive from the at least one player in a turn a first wager or series of wagers relating to the associated dice game, to receive a first dice roll, utilizing the first set of dice, the first dice roll having an outcome that depends on the two numbers that turn up on the first die and the second die, to receive at least a second dice roll, utilizing the second set of dice, the at least one roll of the second set of dice having an outcome that depends on the three numbers that turn up, and paying a payout to the at least one player as appropriate according to each wager and outcome of the dice rolls.

In a fourth aspect of the present invention, the present invention provides a casino table dice game for a plurality of players including a game table and a layout on the game table including a plurality of money lines and a plurality of player personal gaming areas spaced from each other and the money lines, each player personal gaming area including an upper bet section, a middle bet section, and a lower bet section, a first set of dice, the first set of dice including a first die of a first color and a second die of a second color, a second set of dice including a third die, a fourth die and a fifth die each of the same color, and a match marker for moving along the money lines. Wherein, utilizing the first set of dice, the first dice roll having an outcome that depends on the two numbers that turn up on the first die and the second die, utilizing the second set of dice, the at least one roll of the second set of dice having an outcome that depends on the three numbers that turn up, and paying a payout to the at least one player as appropriate according to each wager and outcome of the dice rolls.

In a fifth aspect of the present invention, the present invention provides a method of playing a dice game with at least one player, a first set of dice, a second set of dice, the first set of dice including a first die of a first color and a second die of a second color, and the second set of dice including a third die, a fourth die and a fifth die each of the same color. The method includes the steps of determining a roller of the first set of dice in a turn, establishing, by the roller of the first set of dice, a match number for the first roll of a turn, the match number being associated with the roller of the first set of dice, and establishing in connection with the match number an anti-match number for the first roll of a turn, this anti-match number being predetermined according to the established match number. The method also includes the steps of receiving from the at least one player in a turn a wager or series of wagers relating to the associated dice game, receiving a first dice roll, utilizing the first set of dice, the first dice roll having an outcome that depends on the two numbers that turn up on the first die and the second die, receiving at least a second dice roll, utilizing the second set of dice, the at least one roll of the second set of dice having an outcome that depends on the three numbers that turn up, and paying a payout to the at least one player as appropriate according to each wager and outcome of the dice rolls.

In a sixth aspect of the present invention, the present invention provides a method of providing a dice game with multiple sets of dice to a plurality of players, utilizing a first set of dice and a second set of dice. The first set of dice includes a first die of a first color and a second die of a second color. The second set of dice includes a third die, a fourth die and a fifth die each of the same color. The method includes the steps of determining the roller of the dice in a turn, establishing, by the roller of the dice, a match number for the first roll of a turn, the match number being associated with the roller of the dice, establishing in connection with the match number an anti-match number for the first roll of a turn, this anti-match number being predetermined according to the specific established match number, receiving from each player in a turn a first wager or series of wagers relating to the associated dice game, receiving a first dice roll, utilizing the first set of dice, the first dice roll having an outcome of the first die and an outcome of the second die, receiving at least a second dice roll, utilizing the second set of dice, the at least one roll of the second set of dice having an outcome that depends on the three numbers that turn up, and paying a payout to each player as appropriate according to each wager and the outcome of the dice roll.

One advantage of the present invention is that it is a new system, game table, and method of providing and conducting a dice game with multiple sets of dice. A further advantage of the present invention is that it provides a novel series of betting experiences for players by the use of two sets of dice—one set having two dice that are rolled only in the first roll of a turn and the other set having three dice which are rolled in any other roll of the turn—whereby each type of bet allowed in the game has different wager odds based on the number of dice rolled. Another advantage of the present invention is that by having either two or three dice in a roll its wager odds provide a house advantage for each bet. Yet another advantage of the present invention is the display of the Match Number on a Match Number marker and the display of the Anti-Match Number on an Anti-Match Number marker so as to clearly indicate to each player both of these numbers before each roll of the dice. Another advantage of the present invention is that the dice game with multiple sets of dice allows for a roll of two dice to determine the match number and anti-match number for each subsequent roll of three dice. Another advantage of the present invention is that it reduces the maximum number of dice rolled from four to three. Still another advantage of the present invention is that the dice game with multiple sets of dice allows a player to choose a "Match Number" for the first roll of a turn, which gives the player some control over the numbers rolled on the dice. Yet another advantage of the present invention is that the dice game with multiple sets of dice provides "Money Lines" that appear on only one side of a playing surface and allows for oversight by a dealer or surveillance for legitimate bets. A further advantage of the present invention is that the dice game using multiple sets of dice allows for a dealer to be used and played with actual monetary value. Still a further advantage of the present invention is that the dice game with multiple sets of dice provides interactive socializing.

Another advantage of the present invention is that the dice game, in an electronic version, is not limited in the number of players and allows for a single or multiple players. Yet another advantage of the present invention is that the dice game with multiple sets of dice provides a first full-table dice game of its kind. Still advantage of the present invention of the dice game with multiple sets of dice, in a game table version, allows up to six players with a dealer to be used in a live casino with faster play.

Other advantages of the present invention will be readily appreciated as the same becomes better understood by reference to the following detailed description when considered in connection with the accompanying drawings.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
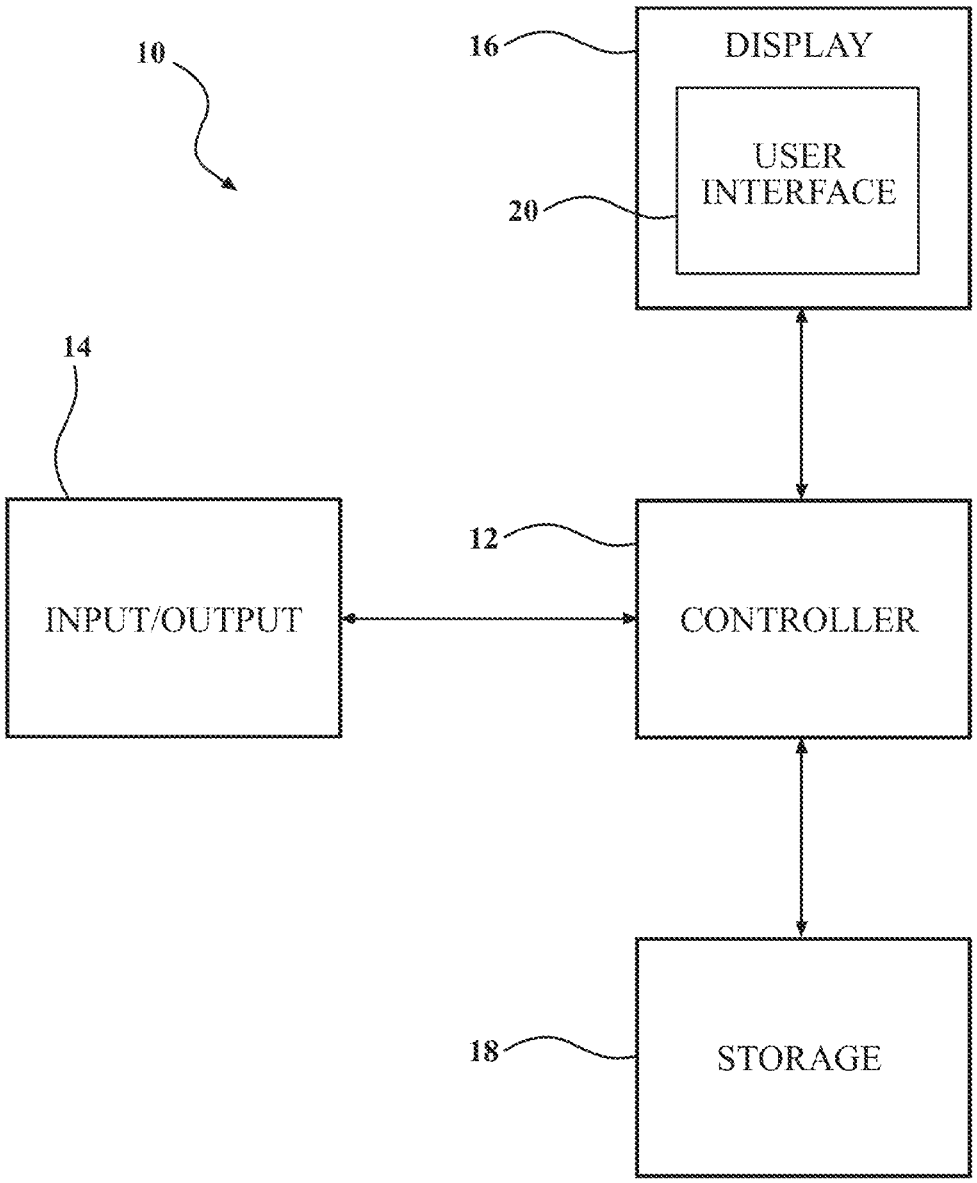
FIG. 1 is a block diagram of a system which allows for electronic gaming of a dice game with multiple sets of dice, according to an embodiment of the present invention.

Corresponding reference characters indicate corresponding components throughout the several views of the drawings Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION OF THE INVENTION

In the following description, numerous specific details are set forth in order to provide a thorough understanding of the present invention. It should be appreciated, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it should be appreciated that the figures provided herewith are for explanation purposes to persons ordinarily skilled in the art and that the drawings are not necessarily drawn to scale.

Embodiments in accordance with the present invention may be embodied as an apparatus, system, method, or computer program product. Accordingly, the present invention may take the form of an entirely hardware embodiment, an entirely software embodiment (including firmware, resident software, micro-code, etc.), or an embodiment combining software and hardware aspects that may all generally be referred to herein as a "module" or "system." Furthermore, the present invention may take the form of a computer program product embodied in any tangible medium of expression having computer-usable program code embodied in such media.

Any combination of one or more computer-usable or computer-readable media (or medium) may be utilized. For example, a computer-readable media may include one or more of a portable computer diskette, a hard disk, a random access memory (RAM) device, a read-only memory (ROM) device, an erasable programmable read-only memory (EPROM or Flash memory) device, a portable compact disc read-only memory (CDROM), an optical storage device, and a magnetic storage device. Computer program code for carrying out operations of the present invention may be written in any combination of one or more programming languages.

Embodiments may also be implemented in cloud computing environments. In this embodiment, "cloud computing" may be defined as a model for enabling ubiquitous, convenient, on-demand network access to a shared pool of configurable computing resources (e.g., networks, servers, storage, applications, and services) that can be rapidly provisioned via virtualization and released with minimal management effort or service provider interaction, and then scaled accordingly. A cloud model can be composed of various characteristics (e.g., on-demand self-service, broad network access, resource pooling, rapid elasticity, measured service, etc.), service models (e.g., Software as a Service ("SaaS"), Platform as a Service ("PaaS"), Infrastructure as a Service ("IaaS"), and deployment models (e.g., private cloud, community cloud, public cloud, hybrid cloud, etc.).

As used herein, the term "mobile device" refers to a device that may from time to time have a position that changes. Such changes in position may comprise changes to direction, distance, and/or orientation. In particular examples, a mobile device may comprise a cellular telephone, wireless communication device, user equipment, laptop computer, other personal communication system ("PCS") device, personal digital assistant ("PDA"), personal audio device ("PAD"), portable navigational device, or other portable communication devices. A mobile device may also include a processor or computing platform adapted to perform functions controlled by machine-readable instructions.

The flowchart and block diagrams in the flow diagrams illustrate the architecture, functionality, and operation of possible implementations of systems, methods, and computer program products according to various embodiments of the present invention. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable media that can direct a computer or other programmable data processing apparatus to function in a particular manner, such that the instructions stored in the computer-readable media produce an article of manufacture including instruction means which implement the function/act specified in the flowchart and/or block diagram block or blocks.

Several (or different) elements discussed below, and/or claimed, are described as being "coupled", "in communication with", or "configured to be in communication with". This terminology is intended to be non-limiting, and where appropriate, be interpreted to include without limitation, wired and wireless communication using any one or a plurality of a suitable protocols, as well as communication methods that are constantly maintained, are made on a periodic basis, and/or made or initiated on an as needed basis.

The methodologies described herein may be implemented by various means depending upon applications according to particular examples. For example, such methodologies may be implemented in hardware, firmware, software, or combinations thereof. In a hardware implementation, for example, the controller or processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the description included herein are presented in terms of algorithms or symbolic representations of operations on binary digital signals stored within a memory of a specific apparatus or special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the signal processing or related arts to convey the substance of their work to others skilled in the art. An algorithm is here, and generally, considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be appreciated, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this description, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

For clarity in discussing the various functions of the system, multiple computers and/or servers are discussed as performing different functions. These different computers (or servers) may, however, be implemented in multiple different ways such as modules within a single computer, as nodes of a computer system, etc. The functions performed by the system (or nodes or modules) may be centralized or distributed in any suitable manner across the system and its components, regardless of the location of specific hardware. Furthermore, specific components of the system may be referenced using functional terminology in their names. The function terminology is used solely for purposes of naming convention and to distinguish one element from another in the following discussion. Unless otherwise specified, the name of an element conveys no specific functionality to the element or component. It should be appreciated that, in selected embodiments, the software, hardware, and associated components of the system may be programmed and configured to implement one or more embodiments described herein. It should also be appreciated that the various aspects of the system may be exemplified as software, modules, nodes, etc. of a computer or server.

The disclosure particularly describes a dice game with multiple sets of dice that may be played as a physical game or as an electronic game. As a physical game, it may be played within the confines of a casino environment where a physical table is dedicated to the dice game and a surface of the table is decorated in a particular way with various indicia so as to make the game conducive, such as a gaming table. The game may also be played in other environments using a cardboard board, a plastic sheet, a material sheet, or some other flat surface that has been decorated in a particular way with various indicia so as to make the game conducive. In one embodiment, the dice game will be described in the context of an electronic game that may be played on any type of computerized system. In another embodiment, the same description that applies to the computerized electronic game likewise applies to any physical embodiment of the game such as a game table that does not use a computerized system or that is a combination of computerize and non-computerized components.

FIG. 1 illustrates a block diagram of a computer system 10 that may be used to operate the dice game, according to the present invention, described herein. The computer system 10 may be part of a personal computer or tablet computing device, an electronic gaming system, such as a slot machine type of device, a table or other physical structure including electronic components, a mobile device, or other wireless type of device, etc. The computer system 10, in its simplest terms, may include at least a controller or processor 12, an input/output system 14, a display 16, and non-transitory storage medium 18. In place of or in addition to the input/output system 14, the display 16 may include a user interface 20 that allows the user to interact with the display 16 to input information, such as through use of a cursor, point device, or an interactive display surface. The input/output 14 and/or user interface 20 may include a microphone, a keypad, a touch screen, an electrical connection, an optical input, or any other suitable means for coupling the input/output 14 or the user interface 20 to the controller or processor 12 of the computer system 10.

The non-transitory storage medium 18 may store computer readable software code or other machine readable instructions that may be read from the storage medium 18 by the controller 12 and may be used to perform numerous different tasks, such as operating the computer system 10, to operating specific applications being used by the computer system 10, such as an application that implements the dice game, according to the present invention, described herein. The storage medium 18 may also store data generated during the dice game that is applicable to one or more players, including information about a player, points or money won by the players, the player's rank among other players, etc.

The non-transitory computer-readable storage medium 18 includes all computer-readable media, with the sole exception being a transitory, propagating signal. The storage medium 18 could be local to the controller 12 or could be remotely located to the controller 12, such as in a client-server type of arrangement. Likewise, the display 16 and input/output 14 and/or user interface 20 may be local to a user, but the controller 12 and storage medium 18 may be located remotely. Further, other arrangements are possible, where there are multiple controllers 12, multiple storage mediums 18, multiple displays 16, etc., with some operations for implementing the dice game being performed by one controller 12 while other operations are performed by another controller 12, where some software code is stored in one storage medium 18 while other software code is stored in other storage mediums 18, and some aspects of the dice game are displayed on one display 16 while other aspects of the dice game are displayed on other displays 16. It should be appreciated that a user interface has indicia applicable to playing the dice game and upon which the dice game can be played, dice can be rolled, bets can be placed, etc., through player interaction. It should also be appreciated that many other variations are possible and incorporated herein.

Figure 2:
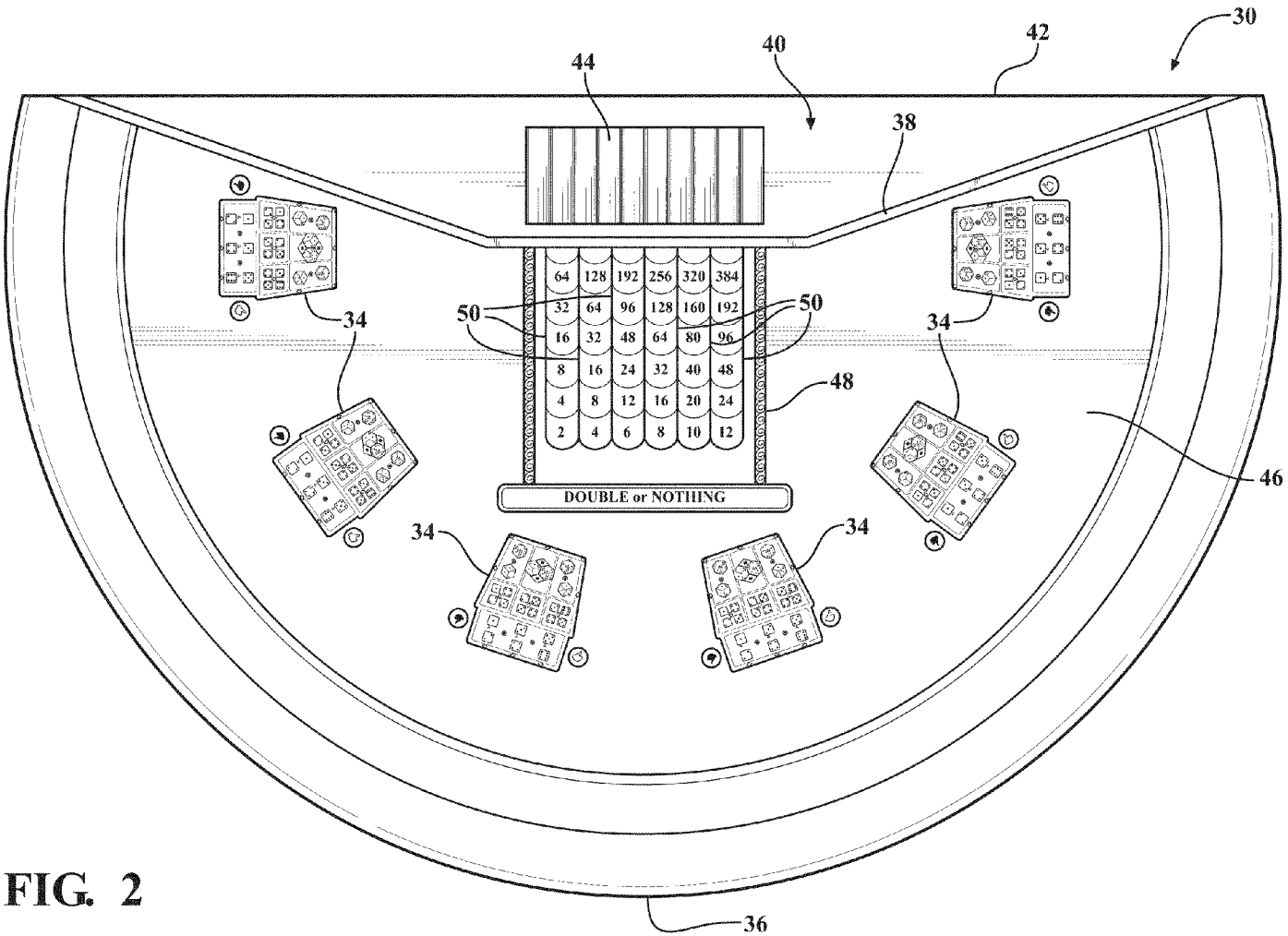
FIG. 2 is a plan view of a game table for a dice game with multiple sets of dice, according to an embodiment of the present invention.

FIG. 2 illustrates one embodiment of a game table 30, according to the present invention, for use in practicing and implementation of the dice game and method of play of the present invention. The game table 30 is a physical table or other surface with indicia applicable to playing the dice game and upon which the dice game can be played, dice can be rolled, bets can be placed, etc. through player interaction. In one embodiment, the game table 30 is generally semi-circular in shape, but may be any suitable shape. The game table 30 has a covering 32 thereon made of felt or other suitable material, having a plurality of player stations or player gaming areas 34 thereon, which are spaced apart around a front side 36 of the game table 30, spaced from a rail 38. As illustrated in one embodiment, there are six (6) player personal gaming areas 34. However, a greater or lesser number of player personal gaming areas 34 may be provided depending upon the size of the playing area. It should be appreciated that more than six (6) players would take longer to play due to the change of the roll of the dice to be described and may result in significant time delays.

The game table 30 also includes a dealer's area, generally indicated at 40, situated along a rear side 42 of the game table 30. The dealer's area 40 may include a money slot (not shown) in which cash given to the dealer as payment for game chips or token is placed in a manner well known to those skilled in the art, a chip or token rack 44 in which house game chips or tokens for use during play of the present game are arranged in columns and stored, and a payout schedule (not shown) which the dealer can refer to as needed. The game table 30 includes a dice throw box 46 located in the center of the game table 30. The dice throw box 46 is preferably recessed in the surface of game table 30, and as described below the dice utilized during play of the game are rolled in the throw box 46. As illustrated, the dice throw box 46 also includes a "Double or Nothing" area 48 having a plurality of money lines 50 to be described. The game table 30 also includes indicia 52 such as logos or other decorative indicia that identifies the game of the present invention, such as the name "Double or Nothing" is also provided in dice throw box 46.

Figure 3:
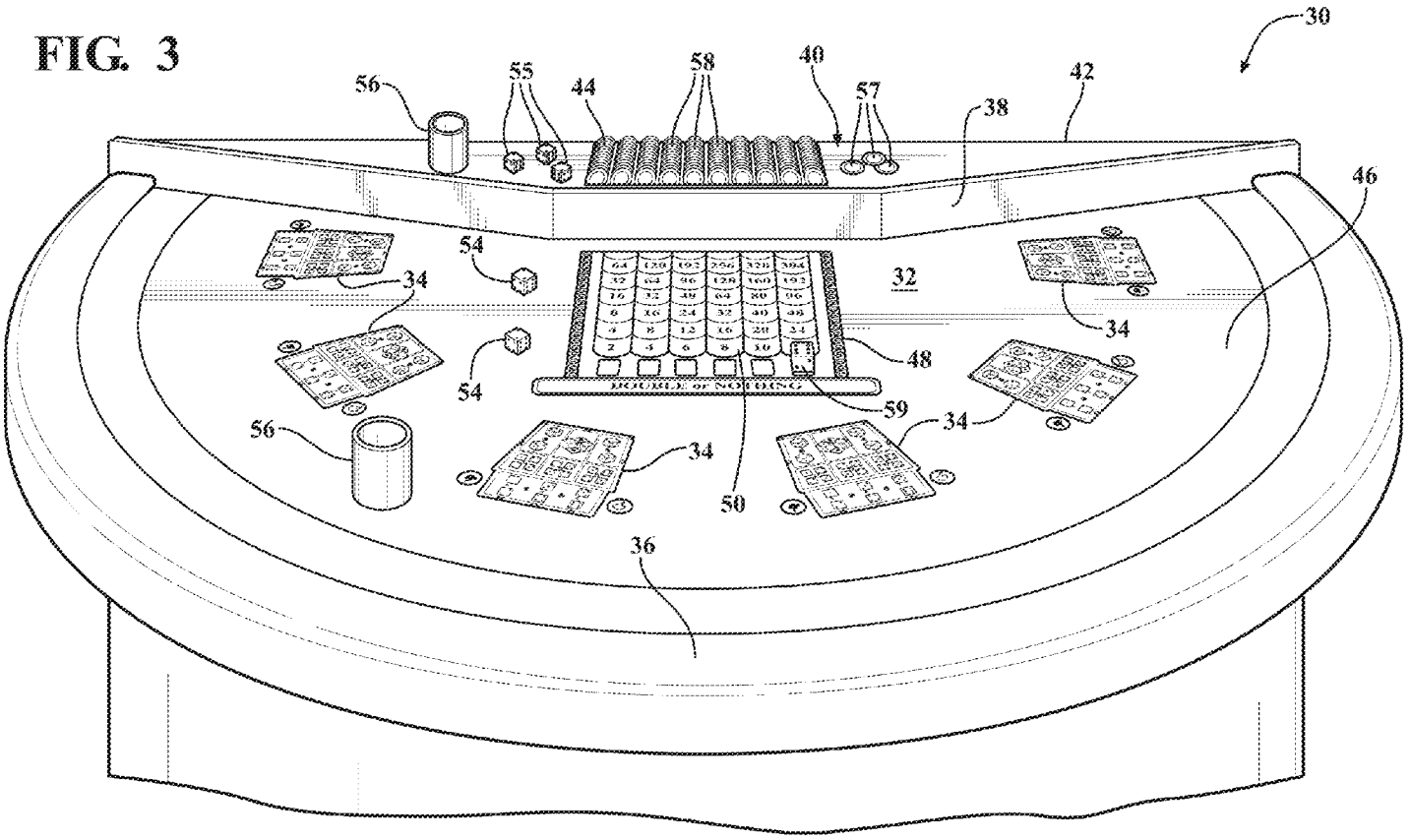
FIG. 3 is a perspective view of the game table of FIG. 2.
Figure 9:
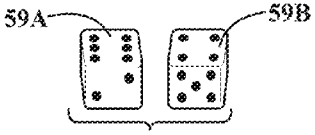
FIG. 9 is a view of number markers of the dice game, according to the present invention, used with the system of FIG. 1 or the game table of FIGS. 2 and 3.

Referring to FIG. 3, the game table 30 includes several accessories utilized during play of the dice game, according to the present invention, namely a first set of two dice 54, a second set of dice 55, one or more dice shakers 56 in which dice 54 and 55 may be placed and which may be used to roll or throw the set of dice 54 and/or 55 during game play, and a plurality of play tokens or casino-style chips 58, a supply of which are kept by the dealer in chip rack 44 on the game table 30, and of course in addition each of the players also will have their own supply of purchased game tokens or chips 58 for use during game play. The game table 30 also includes a plurality of tokens 57 for keeping track of the remaining rolls in a turn; a plurality of number markers, generally indicated at 59, such a Match number marker 59A, a large green die, for use with the money lines 50 for indicating a Match number and yield to "Matchmaker" to be described on the money lines 50, and an Anti-Match number marker 59B for indicating an Anti-Match number as illustrated in FIG. 9. The number markers 59 are of a suitable size and shape so that the rolled dice 54 and 55 will not move the number markers 59 off the money lines 50. In one embodiment, there are two number markers 59A and 59B of different colors known as "Big Green" and "Big Red", respectively. It should be appreciated that any suitable number and colors of number markers 59 may be used. It should also be appreciated that the dice 54 and 55, at least one dice shaker 56, and number markers 59A and 59B will be kept in the dealer's area 40.

Figure 4:
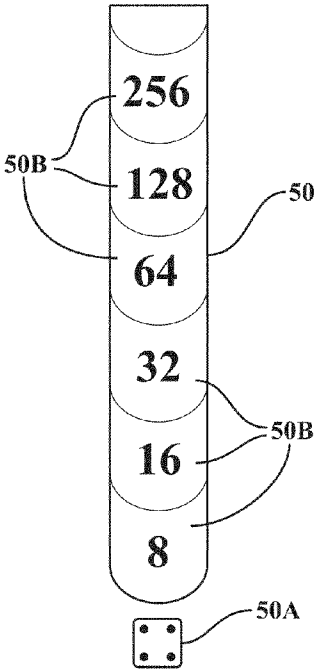
FIG. 4 is a money line of the dice game, according to the present invention, used with the system of FIG. 1 or the game table of FIGS. 2 and 3.

Referring to FIG. 4, one of the money lines 50 of the Double or Nothing area 48 is illustrated. In one embodiment, the Double or Nothing area 48 includes six (6) money lines 50. Each money line 50 has a die symbol 50A in front representing a numerical value of a single die. The die symbol 50A indicates the match number for the rest of a player's turn. The die symbol 50 may be colored, for example green but may be any suitable color. Each money line 50 also has a numerical symbol 50B that progress upward from the die symbol 50A toward the dealer area 40 from a first Arabic numeral or match number to a sixth Arabic numeral or match number. For example, if the match number for the die symbol 50 is four (4), the first Arabic numeral of the numerical symbol 50B will be double the value of the match number and is eight (8). In this example, the doubling of the value for the numerical symbols 50B progresses upward to two hundred fifty-six (256). It should be appreciated that there is one money line 50 for each numerical value or match number of a single die. It should also be appreciated that each money line 50 has the same pattern of doubling—starting with the match number at the bottom.

Figure 5:
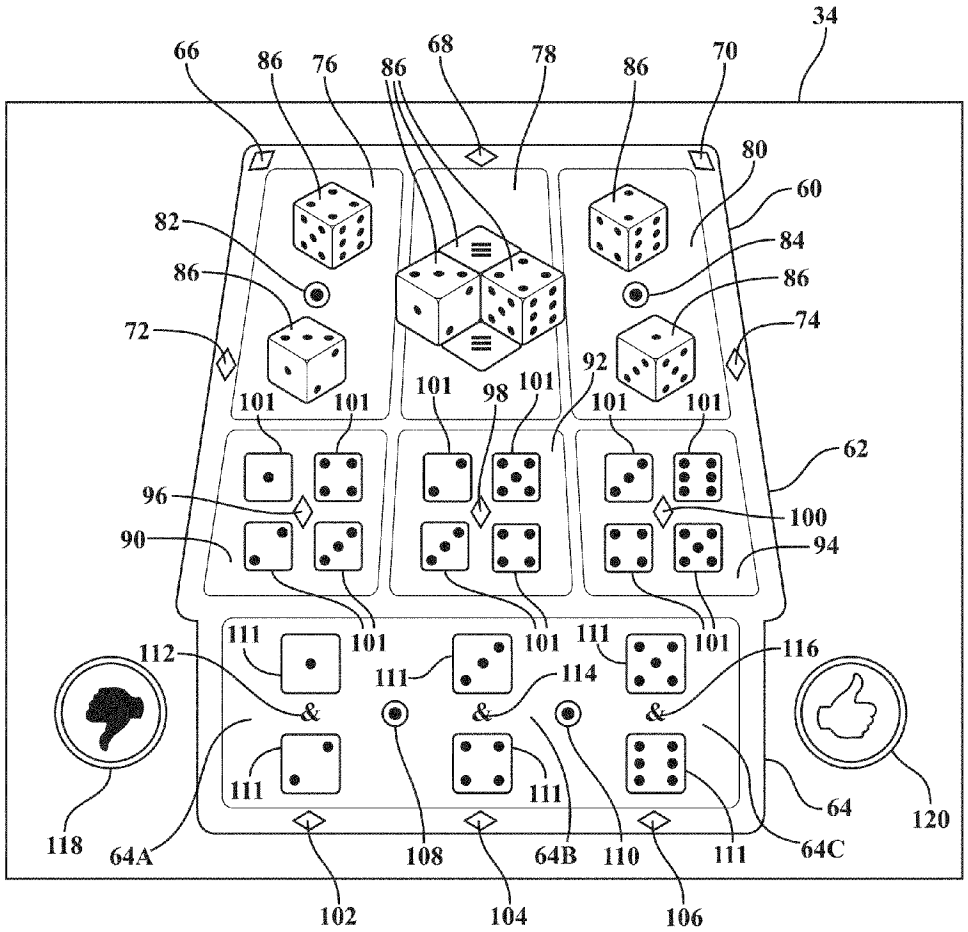
FIG. 5 is a perspective view of a player personal gaming area for use with the system of FIG. 1 or the game table of FIGS. 2 and 3.

Referring to FIG. 5, one embodiment of the player personal gaming area (PGA) 34 is shown. The PGA 34 includes an upper bet section 60, a middle bet section 62, and a lower bet section 64. The upper bet section 60 is at the top of the PGA 34, followed by the middle bet section 62, and followed by the lower bet section 64 toward the player (not shown) and front side 36 of the game table 30. It should be appreciated that the section 60, 62, and 64 could be arranged in any suitable manner.

A plurality of symbols for indicating where wagers are placed is included in the upper bet section 60, the middle bet section 62, and the lower bet section 64. In one embodiment, the first symbol 66, such as a diamond, is in an upper left corner thereof, a second symbol 68, such as a diamond, in the upper middle thereof, a third symbol 70, such as a diamond, in an upper right corner thereof, a fourth symbol 72, such as a diamond, in a lower left corner thereof, and a fifth symbol 74, such as a diamond, in a lower right corner thereof.

The upper bet section 60 also includes a plurality of, preferably three, dice portions such as a first or left dice portion 76, second or middle dice portion 78, and third or right dice portion 80. The upper bet section 60 includes a sixth symbol 82, such as a bull's-eye, in the first dice portion 76 and a seventh symbol 84, such as a bull's-eye, in the third dice portion 80. The upper bet section 60 includes at least one, preferably a plurality of die symbols 86 in the first dice portion 76, second dice portion 78, and third dice portion 80. In the first dice portion 76, there are two die symbols 86 separated by the sixth symbol 82 of the bull's-eye, and in the third dice portion 80, there are two die symbols 86 separated by the seventh symbol 84 of the bull's-eye. It should be appreciated that the symbols 66, 68, 70, 72, 74, 82, and 84 may be any suitable type of symbol. It should also be appreciated that the symbols 82 and 84 of the bull's-eye means represents "either/or". It should further be appreciated that "≡" means the same.

In the upper bet section 60, the first symbol 66 is A. HIGH—but not just 4s, the second symbol 68 is E. the same (≡), and the third symbol 70 is C. EVEM—but not just 2s. The fourth symbol 72 is B. LOW—but not just 3s, and the fifth symbol 74 is D. ODD—but not just 1s. The sixth symbol 82 is EITHER A or B and the seventh symbol 84 is EITHER C or D. It should be appreciated that each of the die symbols 86 has three numeral values.

The middle bet section 62 includes a plurality of, preferably three, dice portions such as a first or left dice portion 90, second or middle dice portion 92, and third or right dice portion 94. The middle bet section 62 includes a first symbol 96, such as a diamond, in the first dice portion 90, a second symbol 98, such as a diamond, in the second dice portion 92, and a third symbol 100, such as a diamond, in the third dice portion 94. The middle bet section 62 includes at least one, preferably a plurality of die symbols 101 in the first dice portion 90, second dice portion 92, and third dice portion 94. It should be appreciated that the symbols 96, 98, and 100 may be any suitable type of symbol. It should be appreciated that each of the die symbols 101 has one numeral value.

In the middle bet section 62, die symbols 101 in the first dice portion 90 have a numerical value range of 1 to 4. The die symbols 101 in the second dice portion 90 have a numerical value range of 2 to 5. The die symbols 101 in the third dice portion 94 have a numerical value range of 3 to 6. The first symbol 96 is F.—in the range 1 to 4, the second symbol 98 is G.—in the range 2 to 5, and the third symbol 100 is H.—in the range of 3 to 6. It should be appreciated that each of these bets is that each number turning up on the next roll will fall within the range of numbers mentioned above.

The lower bet section 64 includes a first symbol 102, such as a diamond, in a lower left corner thereof, a second symbol 104, such as a diamond, in the lower middle thereof, and a third symbol 106, such as a diamond, in a lower right corner thereof. The lower bet section 64 includes a fourth symbol 108, such as a bull's-eye, and a fifth symbol 110, such as a bull's-eye, in the center thereof. The lower bet section 64 includes at least one, preferably a plurality of die symbols 111 in a first or left side dice portion 64A, second or middle dice portion 64B, and third or right side dice portion 64C. The lower bet section 64 includes a sixth symbol 112, such as an ampersand, in the left side dice portion 64A, a seventh symbol 114, such as an ampersand, in the middle dice portion 64B, and an eighth symbol 116, such as an ampersand, in the right side dice portion 64C. It should be appreciated that the symbols 102, 104, 106, 108, 110, 112, 114, and 116 may be any suitable type of symbol. It should also be appreciated that the symbols 114 and 116 of the ampersand means represents "and".

In the lower bet section 64, die symbols 111 to the left have a numerical value range of 1 to 2. The die symbols 111 in the middle have a numerical value range of 3 to 4. The die symbols 111 to the right have a numerical value range of 5 to 6. The first symbol 102 is I.—1 & 2, the second symbol 104 is J. 3 & 4, and the third symbol 106 is K.—5 & 6. The fourth symbol 108 is EITHER I OR J and the fifth symbol 110 is EITHER J OR K. It should be appreciated that the next roll will include these numbers above.

Each PGA 34 further includes a "Thumbs Down" symbol 118 and a "Thumbs Up" symbol 120. As illustrated, the Thumbs Down symbol 118 is located to the left of the lower bet section 64 and the Thumbs Up symbol 120 is located to the right of the lower bet section 64. The Thumbs Down symbol 118 is for a thumbs down bet and the Thumbs Up symbol 120 is for a thumbs up bet. For example, a two-dice thumbs down bet wins if the next dice roll turns up at least one Anti-Match number to be described and a two-dice thumbs up bet wins if the next dice roll turns up at least one Match number to be described. To win a three-dice thumbs down bet, the next dice roll must turn up at least one Anti-Match number. If, however, the dice roll includes one Anti-Match number and two Match numbers, the player loses the bet. To win a three-dice thumbs up bet, the next dice roll must turn up at least one Match number. If, however, the dice roll includes one Match number and two Anti-Match numbers, the player loses the bet.

The winning payouts on a roll of two dice are 2 for 1 on symbols 82, 84, 96, 98, and 100, 4 for 1 on symbols 66, 70, 72, and 74, 5 for 1 on symbol 68, 8 for 1 on symbols 108 and 110, and 16 for 1 on symbols 102, 104, and 106. The winning payouts on a roll of two dice are on the Thumbs Down symbol 118 for an Anti-Match bet, 3 for 1 for one die showing Anti-Match number, and 5 for 1 for two dice showing Anti-Match number; and on the Thumbs Up symbol 120 for a Match bet, 3 for 1 for one die showing Match number, and 5 for 1 for two dice showing Match number.

The winning payouts on a roll of three dice are 4 for 1 on symbols 82 and 84, 3 for 1 on symbols 96, 98, and 100, 8 for 1 on symbols 66, 70, 72, and 74, 33 for 1 on symbol 68, 3 (but with pair, 5) for 1 on symbols 108 and 110, and 6 (but with pair, 10) for 1 on symbols 102, 104, and 106. The winning payouts on a roll of three dice are on the Thumbs Down symbol 118 for an Anti-Match bet, 2 for 1 for one die showing Anti-Match number, 4 for 1 for two dice showing Anti-Match number, and 8 for 1 for three dice showing Anti-Match number; and on the Thumbs Up symbol 120 for a Match bet, 2 for 1 for one die showing Match number, 4 for 1 for two dice showing Match number, and 8 for 1 for three dice showing Match number.

In another embodiment, the dice game, according to the present invention, may be implemented in an electronic version for various configurations such as gaming machines, gaming devices, or gaming systems, including but not limited to: (1) a dedicated gaming machine, gaming device, or gaming system wherein the computerized instructions for controlling any games (that are provided by the gaming machine or gaming device) are provided with the gaming machine or gaming device prior to delivery to a gaming establishment; and (2) a changeable gaming machine, gaming device, or gaming system wherein the computerized instructions for controlling any games (that are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces), and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling the base or primary game of the present disclosure are communicated from the central server to the gaming device in a thick client configuration and computerized instructions for controlling any secondary or bonus games or functions are executed by a central server in a thin client configuration.

In one embodiment, an operator or a player may use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, such as part of a wireless gaming system. In this embodiment, the gaming machine may be a hand-held device, a mobile device, or any other suitable wireless device that enables a player to play the dice game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

The Double or Nothing dice game is a unique dice game, according to the present invention, in that the numbers rolled on the dice are never added together to get a total. Instead, every number is always taken at face value. So on a roll of two dice, if a 1 & 2 turn up, you don't add the numbers together to get to three. They are simply a 1 and a 2. And on a roll of three dice, if the roll turns up a 4, a 5, and a 6, same thing. What you see is what you get: a 4, a 5, and a 6.

Table Game Version Rules of Play

A method of playing the dice game, according to the present invention and named "Double or Nothing", with the game table 30 is disclosed. Players (not shown) take turns-clockwise-rolling the dice 54 and 55. The roller is called Matchmaker. Each other player is a Sidebettor. Before every dice roll, Matchmaker and Sidebettors place all of their wagers on their own personal gaming area (PGA) 34. The bets are settled after each dice roll.

Sets of Dice. In each turn, Matchmaker rolls two different sets of dice 54 and 55. The first set has two dice 54—one green and one red. This first set of dice 54 is used only for the first roll of a player's turn. The second set of dice 55 is explained below.

Types of Bets. In every player's turn, there are seventeen different bets. Fifteen of these bets always involve the same set of numbers. But two of the bets Thumbs—Up and Thumbs Down—involve numbers that often change from turn to turn. These numbers are called the Match number and the Anti-Match number. Each is either a 1, 2, 3, 4, 5, or 6.

Match Number for a Two-Dice Roll. Before handing Matchmaker the set of two dice 54, Dealer asks Matchmaker to choose the Match number for the first roll of the turn. After Matchmaker names it, Dealer shows this Match number—face up—on the Match number marker 59A—large green die (Big Green), and sets it at the upper right side of the "Double or Nothing" area.

Anti-Match Number. On the Match number marker 59A, the number that appears on the opposite side of the Match number is the Anti-Match number. As soon as the Match number is determined, Dealer determines the Anti-Match Number, shows it-face up-on the Anti-Match number marker 59B—large red die (Big Red), and sets it at the upper left side of the "Double or Nothing" area.

After showing the Match and Anti-Match numbers, Dealer says, "Place your bets on the roll of two dice." After the allotted time, Dealer hands Matchmaker the dice cup 56 with the two dice 54 and indicates that time for betting has ended. Matchmaker rolls the dice 54. After the dice roll, Dealer slides the numbers rolled onto the Double or Nothing logo in the center of the table, then settles all bets.

New Match & Anti-Match Numbers and Count of Remaining Rolls. For the rest of the player's turn, the number rolled on the green die of the first set of dice 54 becomes the Match number, and the number on the opposite side of this Match Number becomes the Anti-Match number. Dealer shows the Match number face up on the Match number marker 59A and sets it on its equivalent image in the lower part of the "Double or Nothing" area, and then shows the Anti-Match number on the Anti-Match number marker 59B and sets it next to the rail 38 at the upper left side of the "Double or Nothing" area. The number rolled on the red die on the 2-dice roll shows how many more times Matchmaker is allowed to roll the dice in that turn. To indicate that number to players, Dealer prominently places on a riser one token 57 for each roll allowed.

The Second and Any Other Roll of a Turn. Beginning with the second roll of a player's turn, Matchmaker casts a different or second set of dice 55. This second set of dice 55 has three dice instead of two. And each of them is the same color. So starting with the second roll of a player's turn, Dealer says before each such roll, "Place your bets on the roll of three dice".

Required Bet. Before each three-dice roll, Matchmaker must have a Thumbs Up bet in place on the Thumbs Up symbol 120. The wager placed on the Thumbs Up symbol must have the same number of play tokens or casino-style chips 58 as the Match number, and each must be of the same value.

After the allotted time for placing bets, Dealer hands Matchmaker the dice cup 56 with the three dice 55 and indicates that the time for betting has ended. After the dice roll, Dealer settles all bets.

When Matchmaker Wins a Thumbs Up Bet. Dealer moves the Match number marker 59A, Big Green, up the column of the Money Line 50 one space for each match rolled. The number beneath Big Green then shows the current payout due to Matchmaker. If Matchmaker will roll again, the payout due serves as Matchmaker's required Thumbs Up bet. It should be appreciated that if on the next dice roll Matchmaker again rolls one or more winning matches, the payout due to Matchmaker continues to double. It should also be appreciated that, in the unlikely event that Matchmaker successively rolls so many matches that the payout is not mentioned on the money lines 50, the amount due still continues to double for each Match.

End of Turn. A turn ends whenever Matchmaker: (a) is allowed another dice roll but chooses not to make another Thumbs Up bet; or (b) is allowed another dice roll but takes the payout on the Money Line; or (c) has rolled the three dice 55 as many times as allowed.

Electronic Version Rules of Play

A method of playing the dice game, according to the present invention and named "Double or Nothing", with the computer system 10 is disclosed. In the electronic version, players take turns rolling the dice 54 and 55. The roller is called Matchmaker. In a one-player version, you always play as Matchmaker. It should be appreciated that the dice 54 and 55 are represented electronically as images.

Dice. The first roll of every turn has two dice 54. The second and any other roll has three dice 55.

Interpreting the Numbers Rolled. Numbers are never added together to get a total. The number turned up on each of the dice 54 and 55 is what it is.

Making and Settling Bets. You make bets before each dice roll, and on each dice roll you either win or lose a given bet. Bets are settled after every dice roll.

Personal Gaming Area. Your Personal Gaming Area 34 shows images of dice symbols 86, 101, and 111 and two thumbs icons or symbols 118 and 120 to indicate the numbers you can bet on. The Thumbs Up icon or symbol 120 is used for placing wagers on what's called a Match bet. To begin a turn, a Dealer asks the Matchmaker to choose a Match number from 1 through 6. The number chosen is assigned to the Thumbs Up symbol 120 for the first dice roll. The Matchmaker must place a bet that this number will turn up on at least one of the two dice 54 on the first roll. Requirements for the wager on this bet will be described subsequently. The Thumbs Down icon or symbol 118 is for placing wagers on an Anti-Match bet. This bet is that the Anti-Match number will turn up on the next dice roll. Here's how this number is determined. The numbers on any two opposite sides of casino dice always add up to seven, and on the dice the Anti-Match number appears on the opposite side of the Match number. For example, if a Match number is 4, the Anti-Match number is 3.

Figure 6:
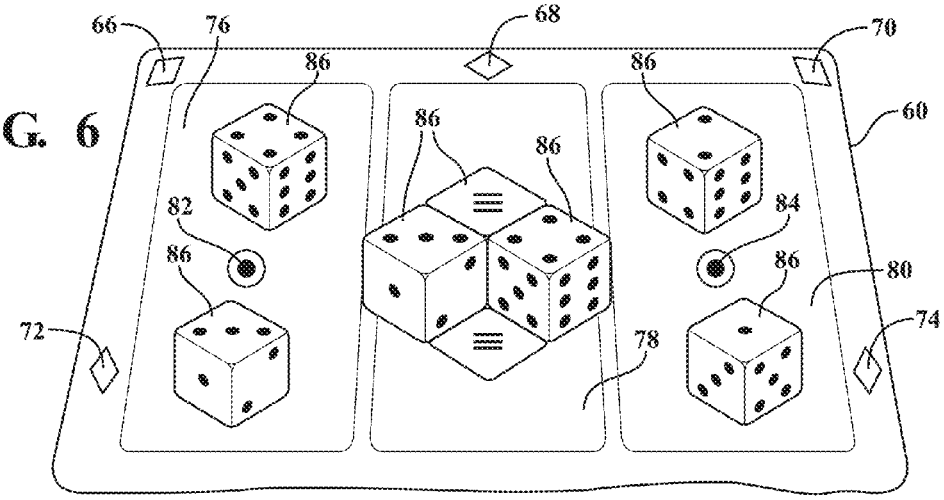
FIG. 6 is a perspective view of an upper bet section of the player personal gaming area of FIG. 5.

The Other Fifteen Bets. The images of the dice symbols 86, 101, and 111 on your personal gaming area (PGA) 34 indicate the numbers involved in each of these bets. Their numbers indicate the nature of each bet described below. These bets are divided into two major categories, according to whether you place your wager on a diamond (◇) icon or symbol 66, 68, 70, 72, 74, 96, 98, 100, 102, 104, 106 or a bull's-eye (⊙) icon or symbol 82, 84, 108, and 110. Bets in the Upper Section 60. As illustrated in FIG. 6, the upper section 60 shows die symbols 86 with the numbers 1, 2, 3, 4, 5, & 6 and Diamond Bets 66 (A), 68 (E), 70 (C), 72 (B), and 74 (D). The number turning up on each of the dice 55 will be:

Symbol 66—A. High (4, 5, 6)—but not just 4s.
Symbol 72—B. Low (1, 2, 3)—but not just 3s.
Symbol 70—C. Even (2, 4, 6)—but not just 2s.
Symbol 74—D. Odd (1, 3, 5)—but not just 1s.

Bull's-eye (⊙) Bets on Symbols 82 (A/B) and 84 (C/D). Each number turning up on the dice 55 will be:

Symbol 82—A/B. Either be High (4, 5, 6)—but not just 4s—or will be Low (1, 2, 3)—but not just 3s.
Symbol 84—C/D. Either be Even—but not just 2s—or will be Odd—but not just 1s.
Symbol 68—E. The same (≡) The math symbol having three parallel lines (≡) means "is the same". So this bet in the middle portion 78 is that each number turning up on the next roll will be the same: either 1s, 2s, 3s, 4s, 5s or 6s.

Figure 7:
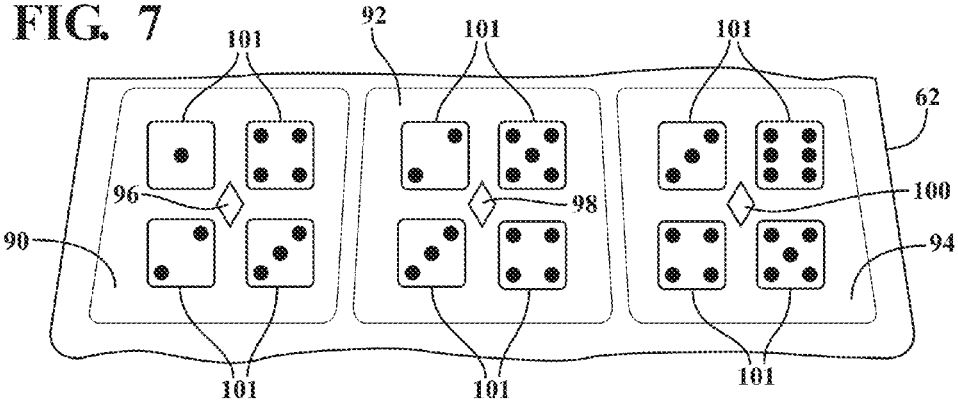
FIG. 7 is a perspective view of a middle bet section of the player personal gaming area of FIG. 5.

Bets in the Middle Section 62. As illustrated in FIG. 7, the middle section 62 shows die symbols 101 with the numbers 1, 2, 3, 4, 5, & 6. The numbers turning up on the next dice roll will fall in the range of:

Symbol 96—F. From 1 to 4.
Symbol 98—G. From 2 to 5.
Symbol 100—H. From 3 to 6.

Figure 8:
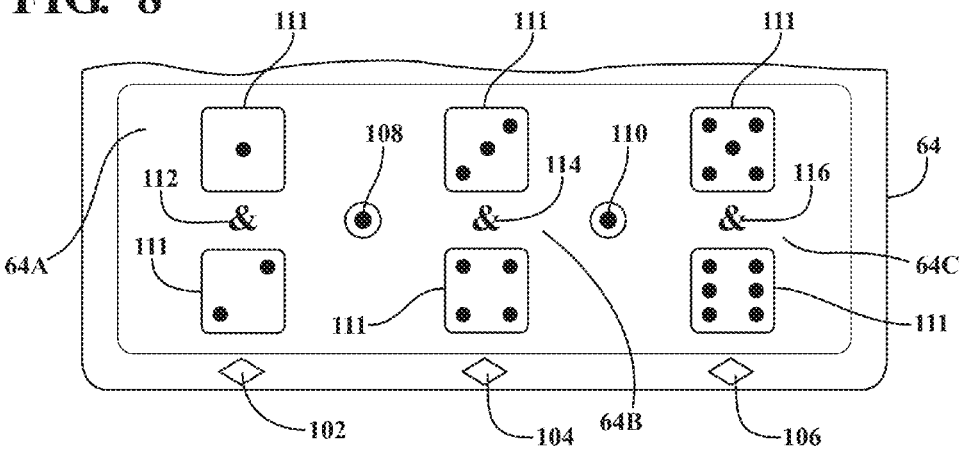
FIG. 8 is a perspective view of a lower bet section of the player personal gaming area of FIG. 5.

Bets in the Lower Section 64. As illustrated in FIG. 8, the lower section 64 shows die symbols 111 with the numbers 1, 2, 3, 4, 5, & 6. The numbers turning up on the next dice roll will include:

Symbol 102—I. Both 1 and 2.
Symbol 104—J. Both 3 and 4.
Symbol 106—K. Both 5 and 6.

Bull's-eye (⊙) Bets on Symbols 108 (In) and 110 (J/K). The numbers turning up on the dice 54 will be, or the numbers turning up on the dice 55 will include:

Symbol 108—I/J. Either both a 1 & 2 or both a 3 & 4.
Symbol 110—J/K. Either both a 3 & 4 or both a 5 & 6.

Obtaining Chips and Your Rail. As known in the art, players may obtain chips 58 from the Dealer or house. It should be appreciated that conventional ways for displaying their values and keeping track of them on the player's rail is also known in the art.

Required Match Bet. As Matchmaker, you must have a match bet in place on the Thumbs Up symbol 120 before each roll of the dice 54 and 55. This is the only required bet. The number of chips 58 in the wager placed on the Thumbs Up symbol wagered must be the same as the Match number, and each chip wagered must have the same value.

The First Roll of a Turn. Both dice 54 used in the first roll of every player's turn have a different color. One is red, and the other green. The different colors, however, don't come into play until after the bets are settled for the first dice roll. The Dealer settles all these bets by collecting the chips 58 wagered on losing bets, and paying out the appropriate value of chips 58 for each bet won.

The Reason for Two Colors of Dice on the First Roll. After the bets are settled for a roll of two dice, the number turned up on the red die of the dice 54 shows how many rolls of the three dice 55 are allowed in the rest of the turn. The number turned up on the green die of the dice 54 becomes the Match number for the rest of the turn, and the number on the opposite side of the Match number becomes the Anti-Match number for the rest of the turn.

Beginning with the Second Roll of a Turn. After bets are settled for the first dice roll, in hand-held electronic devices a Double or Nothing money line 50 appears as a sidebar. The Match number for the roll of three dice 55 appears at the bottom. It should be appreciated that each number above the Match number is double the value of the number below it. Dealer places a Match number marker 59A—called Big Green—on top of the Match number and then uses it to keep track of any payout due to you for winning match bets. It should be appreciated that the Match number marker 59A, Big Green, advances one space up on the money line 50 for each winning match turned up on successive dice rolls.

Winning or Losing a Match Bet. Typically, you win your match bet whenever a match turns up. On a three-dice roll, however, you lose the match bet if one Match number turns up and the Anti-Match number turns up on the other two of the dice 55. Likewise, a Thumbs Down bet is lost if the Anti-Match number turns up on one of the dice 55 and the Match number turns up on the other two of the dice 55. When a three-dice roll turns up one or more winning matches, the Match number marker 59A, Big Green, advances up the money line 50 one space for each. The number on that space tells how many chips 58 are due if you take a payout at that time. The value of each chip 58 due is the same as each chip 58 currently on the Thumbs Up icon or symbol 120. It should be appreciated that the number of chips 58 due includes the chips 58 in your wager.

Once the Match number marker 59A, Big Green, has advanced up the money line 50, if you're allowed to roll the dice 55 again in that turn, you may either take the payout and end that turn, or "Let it ride." When you "Let it ride," that untaken payout becomes your latest match bet. And if your next roll turns up a winning match, the payout shown beneath the Match number marker 59A, Big Green, before the dice roll continues to double for each winning match. However, when a three-dice roll fails to turn up a match, Dealer collects your wager from the Thumbs Up icon or symbol 120. Also, if the Match number marker 59A, Big Green, has advanced up the money line 50, it's returned to the bottom and if you're still allowed another dice roll in that turn, you must make another match bet before being allowed to roll again in that turn.

End of Turn A turn ends whenever Matchmaker: (a) is allowed another dice roll but chooses not to make another Thumbs Up bet or (b) is allowed another dice roll but takes the payout on the Money Line; or (c) has rolled the three dice 55 as many times as allowed. It should be appreciated that, in the electronic version, players could tap on individual icons on the PGA 34 and this would elicit a popup with an explanation of the bet and placement of wager.

Dice. The dice 54 and 55 are in three-dimensions (3-D) and the dice rolls are in 3-D. The outcomes are random and according to genuine odds.

Acquiring and Keeping Track of Chips. The system 10 provides an easy access to purchasing chips 58 and transferring them to rail 38 according to denomination. The system 10 also provides a constant view of the count of each denomination of the chips 58 on the rail 38.

Player Placing Wagers. The system 10 also provides convenient (and pre-specified) motion(s) for player to move the various denominations of chips from rail to each target wagering spot.

Dialog Box. As needed during the course of play, a dialog box appears and gives essential information, for example, "Please choose a match number between one and six." The numbers 1 through 6 appear and player taps on the number of choice. It should be appreciated that, in one embodiment, the player can simply speak the number.

Sex of Dealer, the Visual Signifying Dealer, and Audio for Dialog Box. At the beginning of the dice game, the player chooses whether to have a male or female dealer. A visual signifying the dealer may be, in one embodiment, a hand with a shirt cuff. It should be appreciated that the shape of the hand depends on whether it represents a female or a male. Information presented in the dialog box may be recorded in two voices—one by a female, and the other by a male. The voice heard is according to the choice of a female/male dealer as mentioned above. The default is to have the audio ON. It should be appreciated, however, by tapping on an AUDIO button, the player may choose whether to have the audio ON/OFF.

Dealer's Motions. Dealer's motions start at the top of the viewing area. On a First Roll of Turn, after the player chooses the Match number for first roll, the Dealer places the match marker 59, Big Green, at bottom of the money line 50 to indicate match number. After the time for placing wagers is ended, Dealer: (a) shows waving motion to indicate the end of betting time. And after about five seconds, (b) reaches to dice cup 56 at player's rail and drops in the appropriate set of dice 54, 55. After the roll, Dealer: (a) slides the dice—with their numbers still facing up—to top of viewing area; (b) Settles bets by: (1) picking up any lost wager(s) and withdrawing hand out of sight at top (to simulate placing chips on dealer's rail); (2) paying out appropriately colored chips for each bet won. Payouts are to be placed next to winning wagers; and (c) places the match marker, Big Green, at the bottom of the appropriate money line 50 to indicate the Match number for the roll of three dice 55.

Dialog Box. "Please place your bets on the roll of three dice." Then Dealer moves the match marker 59, Big Green, up/down the money line 50 according to whether or not any winning match(es) turned up.

Enabling Player's Motions and their Consequences. After a payout is completed, the player must slide each dealer-paid payout to an Auto-sort section on the rail. [Dialog Box: For the first few turns a dialog box appears and notifies player of this. In time, it doesn't appear unless player doesn't perform that task.]. When the player releases the payout on Auto-sort, each chip 58 is to be sorted according to its denomination, and the window showing the count of chips 58 of that denomination is to change accordingly. If—and only if—allowed another 3-dice roll in the turn, the player is allowed: (a) to leave in place an identical wager placed on the previous dice roll, or (b) to increase that wager by sliding one or more chips on top of it. It should be appreciated that, to make any other wager on the same bet, the player must slide the former wager to the rail before placing the new wager.

Clearing Chips from Playing Area at End of Turn. The Dialog Box appears at end of turn. "End of turn." If any chips are on the PGA, "You must move all chips to your rail."

Miscellaneous. In hand-held electronic versions, the Match number is displayed in a window below Thumbs Up symbol 120 and the Anti-Match number in a window beneath the Thumbs Down symbol 118. These may be displayed either by Arabic numerals or by dice faces with pips. And in the upper portion of the screen a window is used to display the count of three-dice rolls remaining in the turn. It should be appreciated that for introducing players to the play step-by-step, one or more bets could be introduced through "Becoming acquainted with the game exercises." It should also be appreciated that glitzy visual displays, such as erupting chips during a payout, audible whizzy whooshes, dingy noises, etc., must be avoided to maintain the conventional absence of such, as at live casino gaming tables.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of playing a dice game with at least one player, a first set of dice with each die having a representation of numbers from one through six, a second set of dice with each die having a representation of numbers from one through six, the first set of dice including a first die of a first color and a second die of a second color different from the first color, and the second set of dice including a third die, a fourth die and a fifth die each of the same color, a game layout having a playing area and at least one of personal gaming area, the playing throw area having a plurality of money lines and the personal gaming area having a plurality of symbols for indicating where bets are placed, a plurality of markers for use with the money lines, and a plurality of chips for use with the personal gaming area, the method comprising the steps of:

obtaining a number of chips by the at least one player;

placing a bet of at least one of the number of chips by the at least one player in the at least one personal gaming area;

determining a roller of the first set of dice in a turn;

facilitating play of the game by rolling and stopping the first set of dice;

settling the bet for a first roll of the first set of dice by collecting the chips wagered on a losing bet and paying out an appropriate value of chips for a winning bet;

establishing, by the first roller of the first set of dice, a number of rolls of the second set of dice by determining a number turned up on the first die of the first set of dice;

establishing, by the roller of the first set of dice, a match number on a match marker of the markers having the first color for the first roll of a turn, the match number being associated with the roller of the first set of dice and determined by a number turned up on the second die of the first set of dice;

establishing in connection with the match number an anti-match number on an anti-match marker of the markers having the second color for the first roll of a turn, this anti-match number being predetermined according to the established match number;

placing another bet of at least one of the number of chips by the at least one player in the at least one personal gaming area in a turn as a wager or series of wagers relating to rolls of the second set of dice;

facilitating play of the game by rolling and stopping the second set of dice;

placing, by a dealer, the match number marker for the roll of the second set of dice on top of a match number at a bottom of the money lines to keep track of any payout due for winning match bets;

placing, by the dealer, the anti-match marker in the playing area on the game layout;

utilizing the second set of dice to determine an outcome that depends on the three numbers that turn up on the third die, fourth die, and fifth die;

moving the match number marker up the money lines for each winning match turned up on successive die rolls and returning the match number marker to the bottom of the money lines for each losing match turned up on successive rolls; and settling each bet after each roll of the second set of dice and paying a payout of chips to the at least one player as appropriate according to each wager and outcome of the dice rolls of the second set of dice.

2. A method of playing a dice game as set forth in claim 1 using the at least one personal gaming area for placing wagers, each such personal gaming area including an upper bet section, a middle bet section, and a lower bet section.

3. A method of playing a dice game as set forth in claim 2 wherein the upper bet section includes a first dice portion, a second dice portion, and a third dice portion.

4. A method of playing a dice game as set forth in claim 3 wherein the upper bet section includes a plurality of die symbols in the first dice portion, the second dice portion, and the third dice portion to indicate the winning numbers with a given bet on the next roll of the dice.

5. A method of playing a dice game as set forth in claim 2 wherein the middle bet section includes a first dice portion, a second dice portion, and a third dice portion.

6. A method of playing a dice game as set forth in claim 5 wherein the middle bet section includes a plurality of die symbols in the first dice portion, the second dice portion, and the third dice portion to indicate the winning numbers associated with a given bet on the next roll of the dice.

7. A method of playing a dice game as set forth in claim 2 wherein the lower bet section includes a plurality of pairs of die symbols to indicate the winning numbers associated with a given bet on the next roll of the dice.

8. A method of playing a dice game as set forth in claim 2 further utilizing a Thumbs Up bet symbol and a Thumbs Down bet symbol.

9. A method as set forth in claim 2 including the step of determining the anti-match number as the opposite of the match number and showing the anti-match number face up on the anti-match marker.

10. A method for playing a dice game as set forth in claim 9 including assigning the anti-match number to a Thumbs Down bet symbol.

11. A method as set forth in claim 9 including the step of the roller placing on his/her Thumbs Up bet symbol a wager wherein a number of betting counters equals the match number and the denomination of each one of the betting counters is identical.

12. A method as set forth in claim 11 including the step of establishing the number rolled on the second predetermined color of one die of the first set of dice as the number of times the roller is allowed to roll the second set of dice in that turn.

13. A method as set forth in claim 11 including the step of requiring the roller to have a wager in place on the Thumbs Up bet symbol before each roll of the dice, the number of betting counters on the Thumbs Up bet symbol equal to the Match number and each such counter being of the same denomination.

14. A method as set forth in claim 1 including the step of placing wagers on the at least one personal gaming area before every dice roll.

15. A method for playing a dice game as set forth in claim 14 including utilizing the match number marker for showing the match number being assigned to the Thumbs Up bet symbol for each roll of the second set of dice.

16. A method for playing a dice game as set forth in claim 14 including utilizing the anti-match number marker for showing the anti-match number being assigned to the Thumbs Down bet symbol for each roll of the second set of dice.

17. A method for playing a dice game as set forth in claim 1 including the step of choosing the match number for the first roll of the turn and showing this match number—face up—on the match number marker.

18. A method as set forth in claim 17 including assigning the match number to a Thumbs Up bet symbol.

19. A method as set forth in claim 17 including the step of placing bets on the first roll of the second set of dice after showing the match and anti-match numbers.

20. A method as set forth in claim 1 including the step of settling all bets after each roll of the dice.

21. A method as set forth in claim 1 including the step of assigning the number rolled on a first predetermined color of one die of the first set of dice as the match number for the rest of the turn and the number on the opposite side of that die as the anti-match number for the rest of the turn.

22. A method for playing a dice game as set forth in claim 1 wherein utilizing the first set of dice, the first dice roll in a turn resulting in a plurality of outcomes, each specific outcome depending on the combination of the individual numbers turning up on the first die and the second die, comprising:

the win or loss of each given bet made by the at least one player, each win after the bets are settled for the first roll of a given turn, the number turning up on the first die of the first set of dice determining both the match number and the anti-match number for the rest of the turn, the match number being the number turning up on the first die, and the anti-match number being the number appearing on casino dice on the opposite side of the match number; and the number turning up on the second die of the first set of dice determining the number of rolls of the second set of dice the roller is allowed to roll in the remainder of that turn.

23. A method for playing a dice game as set forth in claim 1 wherein each roll of the second set of dice has an outcome that depends on the three numbers that turn up, and payout to each player according to each wager and the outcome of each dice roll.

24. A method for playing a dice game as set forth in claim 1 utilizing six of the money lines, wherein at the bottom of each is a depiction of a distinctive die symbol, each representing a separate match number from one to six, and above each depicted match number a series of Arabic numerals, the first such numeral above each match number having a value that is double that of the match number, and each additional upwardly located Arabic numeral having a value that is double that of the numeral immediately below it, with each value of said Arabic numerals in a given money line for indicating potential payouts due when taking a payout on that money line.

25. A method for playing a dice game as set forth in claim 24 utilizing the match number marker for displaying the match number face up, and before the first roll of the set of three dice in a turn placing that marker on its corresponding match number symbol for indicating the specific match number and money line used for each roll of the set of three dice in that turn.

26. A method for playing a dice game as set forth in claim 25 including the step of advancing the match number marker up the appropriate money line to the next higher numeral for each winning match number rolled, and considering any given Arabic numeral covered by the match number marker as identifying the current money line payout due to the roller based on the roller's most recent roll of the set of three dice.

27. A method for playing a dice game as set forth in claim 26 including returning the match number marker from its position on an Arabic numeral to its corresponding match number symbol when a roll of the second set of dice fails to turn up a winning match number.

28. A method for playing a dice game as set forth in claim 26 including providing to a roller who is allowed another roll of the set of three dice and is due a payout on the money line the option of either taking the money line payout and ending that turn or letting the current money line payout ride so as to continue the turn.

29. A method for playing a dice game as set for the in claim 1 wherein the method is embodied in an electronic medium.

30. A method for playing a dice game as set forth in claim 1 wherein the method is embodied in a game table.

* * * * *